US006895888B1

(12) United States Patent
Spillman

(10) Patent No.: US 6,895,888 B1
(45) Date of Patent: May 24, 2005

(54) TELESCOPIC ATTACHABLE ACCESSORY CONTAINER WITH BOOKMARK FOR BOOKS

(76) Inventor: Kareem Rahmon Spillman, 43-10 48th Ave. #2L, Woodside, NY (US) 11377

( * ) Notice: Subject to any disclaimer, the term of this patent is extended or adjusted under 35 U.S.C. 154(b) by 0 days.

(21) Appl. No.: 10/775,160

(22) Filed: Feb. 11, 2004

(51) Int. Cl.[7] ..... B42D 9/00; B65D 85/28

(52) U.S. Cl. ..... 116/238; 116/339; 281/42; 206/371; 206/443

(58) Field of Search ..... 116/234, 235, 116/236, 237, 238, 239, 240; 281/42, 456; 40/658, 666; 206/371, 443, 805; 220/8, 345.1, 345.2, 345.4

(56) References Cited

U.S. PATENT DOCUMENTS 150,929 A * 5/1874 Zuchkschwerdt ..... 220/345.4
1,513,611 A * 10/1924 Laird ..... 220/527
1,784,621 A * 12/1930 Boyer ..... 47/41.1
1,827,396 A * 10/1931 Luckett ..... 220/8
1,887,299 A * 11/1932 Friedman ..... 401/82
4,162,800 A * 7/1979 Gonot et al. ..... 281/42
4,986,572 A * 1/1991 Kuykendall ..... 281/15.1
5,054,816 A * 10/1991 Rosengarten ..... 281/42
D325,929 S * 5/1992 Larson et al. ..... D19/34
5,325,959 A * 7/1994 Goldberger ..... 206/5
5,667,064 A * 9/1997 Bauman ..... 206/214
5,881,434 A * 3/1999 Rigney ..... 24/11 R
6,109,204 A * 8/2000 Hoey et al. ..... 116/234
6,446,803 B1 * 9/2002 McKinney ..... 206/371
6,481,367 B2 * 11/2002 McClosky ..... 116/235

* cited by examiner

*Primary Examiner*—R. Alexander Smith

(57) ABSTRACT

An apparatus that holds pens, pencils, highlighters, and similar objects that is both functional and decorative. The hollow, semicircular shaped body telescopes, with the opening on the inner most sleeve. Attached to the inner most sleeve is a lid. The lid has a tab that locks the contents securely within the container. The inner most sleeve has a hidden compartment that secures the elastic and a bookmark. The outer most sleeve connects to the inner most sleeve. The elastic band wraps around the outside of the container and is removably connected to the outer most sleeve using a release anchor, which hooks onto the outer most sleeve. This elastic band is how the container is attached to the book spine. The inner most sleeve has a protuberance that is designed to set within a groove which is on the outer most sleeve.

8 Claims, 4 Drawing Sheets

TELESCOPIC ATTACHABLE ACCESSORY CONTAINER WITH BOOKMARK FOR BOOKS

FIELD OF THE INVENTION

The present invention relates generally to an apparatus that attaches to the spine of a book and, more particularly, to a holder for pens, pencils, highlighters and similar objects as well as a bookmark.

BACKGROUND OF THE INVENTION

Since the beginning of civilized time, there have been a need to store writing instruments in a safe location, that is easy to retrieve, and reliably that the writing instruments will not be damaged.

Initially, there have been cups and bookmarks with clips that were designed to hold writing instruments. Now inventors are developing ways to more conveniently store these writing instruments. These holders are found in stores, outlets, and mail order catalogs, for example, in U.S. Pat. Des. 325,929 and 4,162,800 and 5,881,434.

Prior art holders are inherently unreliable, they can not hold multiple writing instruments, they support a limited variety of book sizes, the writing instruments can be damaged or injury can happen to the user, they are heavy and bulky. There is a tendency for them not to be where you last put them. They take up too much space and are not attractive to display.

It is therefore an object of the invention to provide a container for pens, pencils, highlighters, and similar objects.

It is another object of the invention to provide the container that can be attached to the spine of a book.

It is a further object of the invention to provide a container that disconnects the two sleeves and remove the jammed contents inside.

It is another object of the invention to provide a container that reconnects the two sleeves and return the container to its original state.

It is an object of the invention to provide a bookmark for the user.

It is also an object of the invention to provide a container that can adjust to the size of a variety of books.

It is an object of the invention to provide a container that secures the contents inside and easy retrieval of the contents.

It is an object of the invention to provide a container that releases the elastic band so the user can attach and detach the container to the book more easily.

SUMMARY OF THE INVENTION

In accordance with the present invention, there is provided an apparatus that holds pens, pencils, highlighters, and similar objects that is both functional and decorative. The hollow, semicircular shaped body telescopes, with the opening on the inner most sleeve. Attached to the inner most sleeve is a lid. The lid has a tab that locks the contents securely within the container. The inner most sleeve has a hidden compartment that secures the elastic band and a bookmark. The outer most sleeve connects to the inner most sleeve by means of a protuberance located on the inner most sleeve and a groove located on the outer most sleeve. The elastic band wraps around the outside of the container and is removably connected to the outer most sleeve using a release anchor, which hooks onto the outer most sleeve. This elastic band is how the container is attached to the book spine.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the figures.

DESCRIPTION OF THE PREFERRED EMBODIMENT

Figure 1:
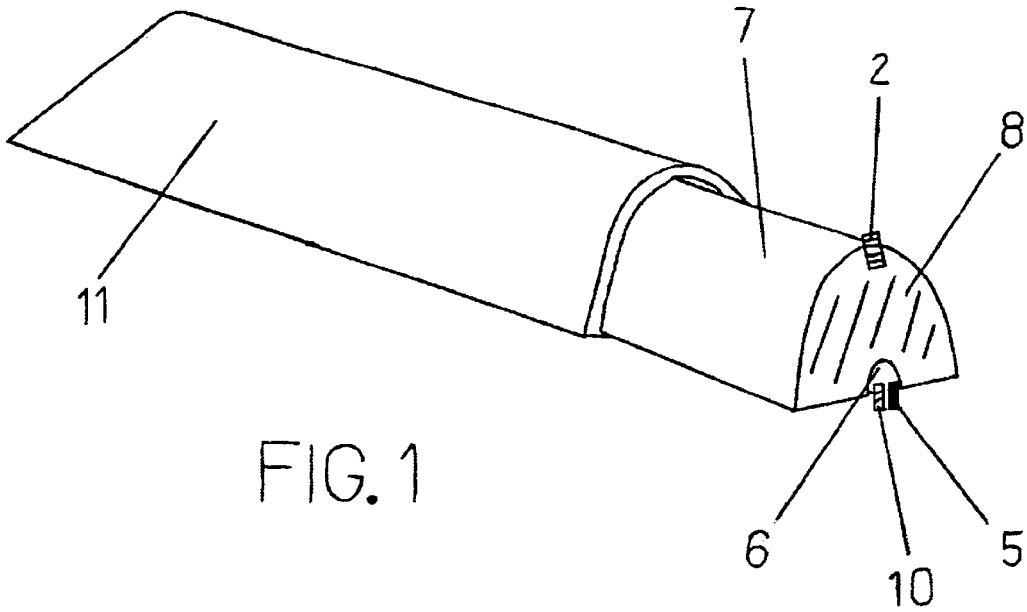
FIG. 1 is a left side perspective view of a container constructed to represent the invention, showing the upper section of the container.

FIG. 1 is a left side perspective view of a container constructed to represent the invention, showing the upper section of the container. The container attaches to the spine of a book, and serves as a holder for pens, pencils, highlighters, and similar objects as well as a bookmark 10. The container takes the form of two semicircular sleeves, the inner most sleeve 7 and the outer most sleeve 11, which slide inside one another. This feature allows it to adjust to the height of any book. The inner most sleeve 7 and the outer most sleeve 11 can be constructed of plastic, metal, wood, or any other suitable material. One of the sleeves is provided with a flip open lid 8 on one end that allows the user to retrieve the writing instruments or similar objects that may be stored inside. There is an area on the lid 8 with an opening 6, that allows the elastic band 5 and the bookmark 10 to be secured to the compartment 9 in the inner most sleeve 7. The lid 8 also has a lid 8 latch that locks the lid 8 closed when the writing instruments and similar objects are placed inside, and when the lid 8 latch is pressed, the writing instruments and similar objects can be retrieved. The invention is attached to the book by an elastic band 5, similar in appearance to a large rubber band, which grips the book by the spine area. Additionally the container is provided with a flexible bookmark 10 that may be used to mark the page where the reader leaves off.

Figure 2:
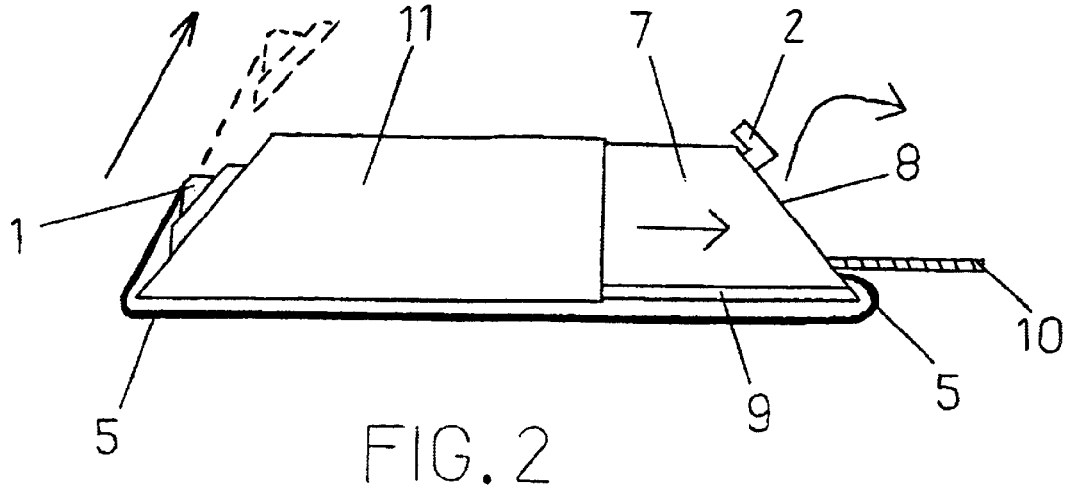
FIG. 2 is a left side orthogonal view of a container in FIG. 1.

FIG. 2 is an orthogonal left side view of the container in FIG. 1. The drawing shows the compartment 9 where the elastic band 5 and the bookmark 10 are secured. The inner most sleeve 7 and the outer most sleeve 11 are shown with the directional marker showing the way the container is to telescope to the extended position. The drawing shows the lid latch 2 and the lid 8, with the directional marker showing the way the lid 8 is to open for the writing instruments and similar objects to be stored and retrieved. The drawing also shows the release anchor 1 that allows the reader to attach and detach the container on the book.

Figure 3:
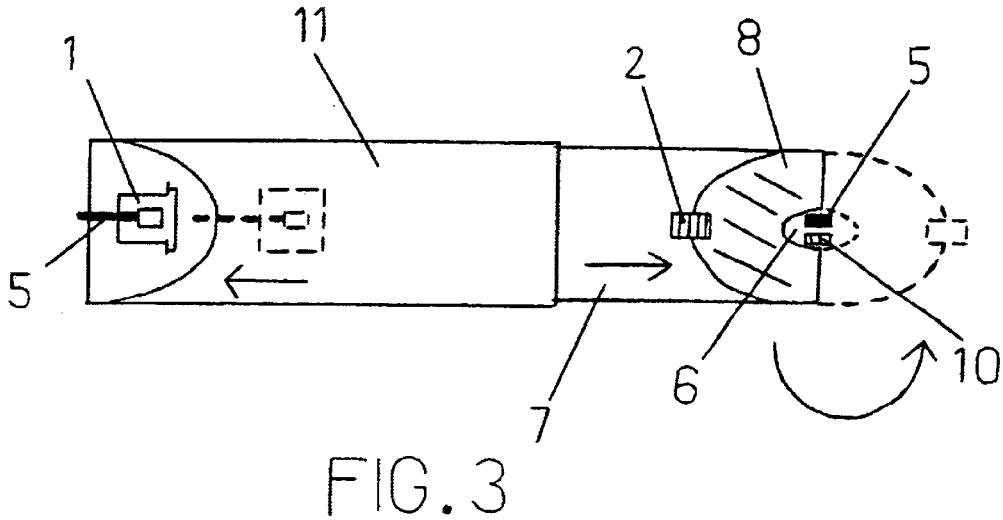
FIG. 3 is a from above orthogonal view of a container in FIG. 1.

FIG. 3 is an orthogonal view from above of the container in FIG. 1. The drawing shows the inner most sleeve 7 and the outer most sleeve 11 with the directional marker showing the motion of the telescoping feature. The drawing shows the release anchor 1 and the directional marker showing the motion that is needed to attach it from the outer most sleeve 11.

Figure 4:
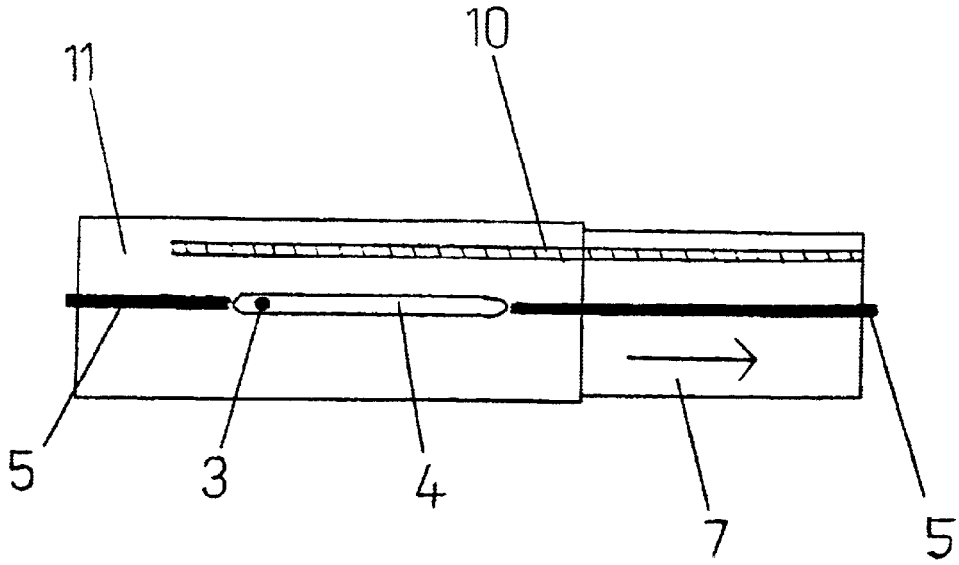
FIG. 4 is a bottom orthogonal view of a container of FIG. 1.

FIG. 4 is an orthogonal view of the bottom of the container of FIG. 1. The drawing shows the protuberance 3 and how it fits into the groove 4. The protuberance 3 is used to keep the container from over extending without the user wanting it to. The protuberance 3 slides the length of the groove 4 and when it reaches the end of the groove 4 it has to stop. When the container is removed from the book the protuberance 3 slides the length of the groove 4 and rests in a fully collapsed position. The drawing also shows the elastic band 5 going the length of the container, keeping the container attached to the spine area of the book. The bookmark 10, connected in the compartment 9 with the elastic band 5 and, extends nearly the length of the body of the container.

Figure 5:
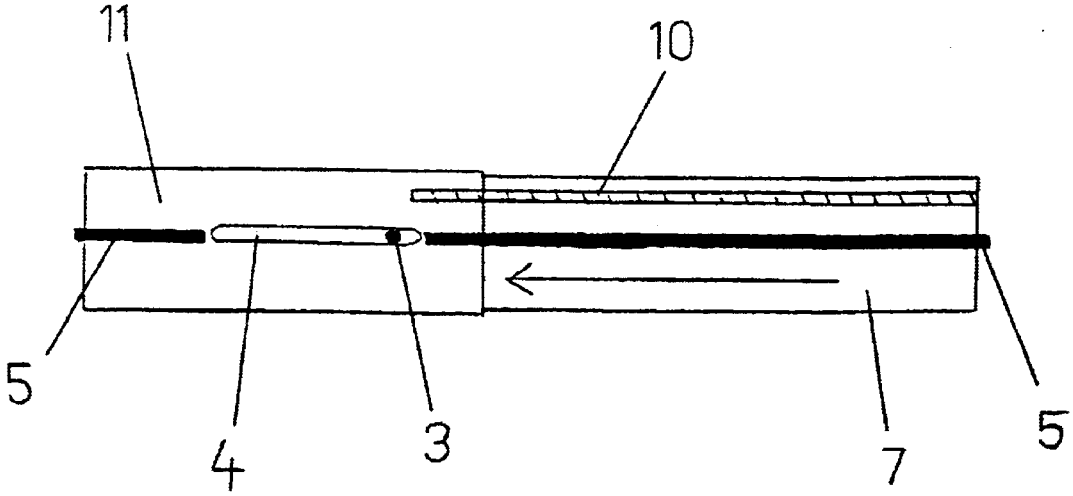
FIG. 5 is a bottom orthogonal view of a container in the extended position of FIG. 1.

FIG. 5 is an orthogonal view of the bottom of the container extended of FIG. 1. The drawing shows the protuberance 3 and the bookmark 10 at the fully extended position. The directional marker shows the way the container is to telescope to the collapsed position. At this fully extended position if the writing instruments and similar objects were to become stuck in the container, the user would have to first release the release anchor 1, press the protuberance 3 and over extend the container to expel the contents. When the contents have been extracted the user would then place the inner most sleeve 7 back within the outer most sleeve 11, press the protuberance 3 to secure it in the groove 4, and collapse the container and replace the release anchor 1.

Figure 6:
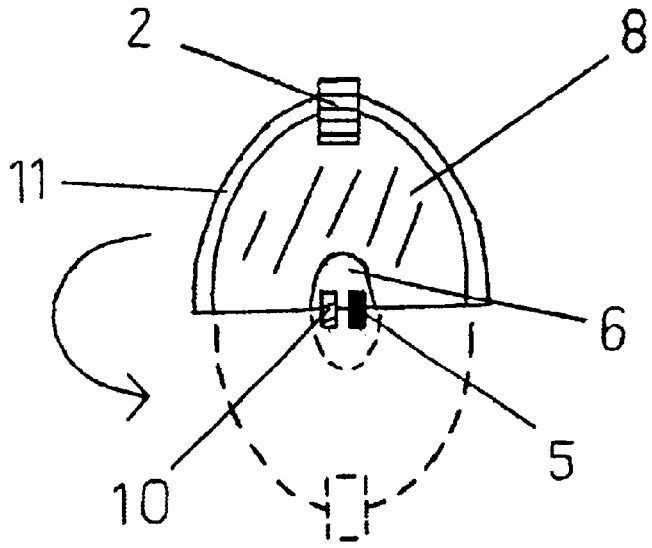
FIG. 6 is a front end orthogonal view of a container of FIG. 1.

FIG. 6 is an orthogonal view of the front end of the container of FIG. 1. The drawing shows the lid 8, lid latch 2, and the opening 6 in the open and shut positions, the directional markers showing the operation. The drawing also shows the elastic band 5 and the bookmark 10 going through the opening 6.

Figure 7:
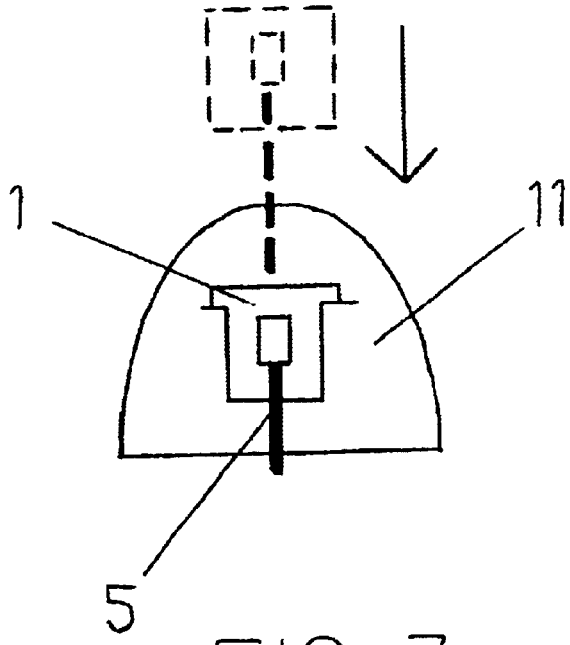
FIG. 7 is a back end orthogonal view of a container of FIG. 1.

FIG. 7 is an orthogonal view of the back end of the container of FIG. 1. The drawing shows the elastic band 5 and the release anchor 1, with the directional marker showing the operation of installing the release anchor 1.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by letters patent is presented in the subsequently appended claims.

What is claimed is:

1. A telescoping container with bookmark comprising:

a container forming an enclosure, said container having an outer sleeve and an inner sleeve wherein said inner sleeve slides within the outer sleeve to adjust a length of the container, said enclosure being adapted for holding writing instruments, said outer sleeve having a wall with a groove, said inner sleeve having a wall with a raised protuberance wherein said protuberance slides within said groove to prevent overextending of the sliding inner sleeve when adjusting said length of the container, said inner sleeve having a top end, said top end having an attached pivoting lid and a lid latch for securing the pivoting lid in a shut position, an elastic band attached to the top end of the inner sleeve, said elastic band having a releasable anchor at a distal end for releasably anchoring said elastic band to said outer sleeve, said elastic band forming a loop adapted to secure the container with bookmark to a spine of a book, a flexible bookmark attached to said top end of the inner sleeve adjacent said elastic band, the bookmark having a length adapted to be inserted between pages of a book, said pivoting lid including a small opening, said elastic band and said bookmark passing through said opening to be attached within said inner sleeve.

2. The telescoping container with bookmark of claim 1 wherein said raised protuberance is pressable to allow disconnection of said sleeves from one another.

3. The telescoping container with bookmark of claim 2 wherein said sleeves are reconnectable to return said container to its original state.

4. The telescoping container with bookmark of claim 1 wherein the length of the container is adapted to accommodate different size books.

5. The telescoping container with bookmark of claim 1 wherein the inner sleeve has a hidden compartment that secures the elastic band and the bookmark.

6. The telescoping container with bookmark of claim 1 wherein the releasable anchor hooks onto the outer sleeve.

7. The telescoping container with bookmark of claim 1 wherein the inner sleeve and the outer sleeve have complementary semicircular cross-sections.

8. The telescoping container with bookmark of claim 1 wherein the lid latch is integral with the lid.

* * * * *